United States Patent [19]

Leung et al.

[11] Patent Number: 4,619,074

[45] Date of Patent: Oct. 28, 1986

[54] CONVERTIBLE DOOR SYSTEM

[76] Inventors: Ignatius Y. P. Leung, 8881-A Fontainbleau Blvd., Apt. 501, Miami, Fla. 33172; Adolfo A. Diaz, 20210 SW. 114th Ct., Miami, Fla. 33157

[21] Appl. No.: 764,756

[22] Filed: Aug. 12, 1985

[51] Int. Cl.[4] ..... E05D 15/00

[52] U.S. Cl. ..... 49/143; 49/125; 49/165; 49/196

[58] Field of Search ..... 49/165, 164, 163, 168, 49/196, 125, 143, 142

[56] References Cited

U.S. PATENT DOCUMENTS

| | | | |
|---|---|---|---|
| 1,956,891 | 5/1934 | Cadoret | 49/165 |
| 3,439,452 | 4/1969 | Kain | 49/143 |
| 3,491,483 | 1/1970 | Miller | 49/163 |
| 4,438,594 | 3/1984 | Bunzl | 49/125 X |

*Primary Examiner*—Philip C. Kannan

*Attorney, Agent, or Firm*—Harvey B. Jacobson

[57] ABSTRACT

A hybrid sliding-pivoting door or window structure comprises one or more pairs of cooperative panels each including a first swinging panel and a second sliding panel. The sliding panel can be moved from a fully closed position in which it is end-to-end with the swinging panel to a semi-open position of the structure in which it is juxtaposed face-to-face with the swinging panel and both panels can then be swung as a unit to fully open the structure and provide substantially unimpeded access across the width of an opening in which the structure is located. The sliding panel is received in a fixed track section when in the fully closed position and moves into a swinging track section associated with the swinging panel.

10 Claims, 7 Drawing Figures

10
12
14
16
18
20
22
23
24
25
26
28
29
30
31
32
33
34
36
38
40
42
44
46
48
50
52

CONVERTIBLE DOOR SYSTEM

BACKGROUND OF THE INVENTION

This invention relates to door and window systems for use in buildings, particularly but not exclusively in domestic dwellings, and provides a combination sliding and pivoting door or window structure, referred generally hereinafter as a "closure". A principle object of the invention is to provide a closure which combines a sliding panel with a pivoting panel in a manner permitting substantially full and unobstructed access across the width of an opening in which the panels operate, in contrast to conventional sliding closures where, generally, access is only available to half of the width of an opening containing a pair of closure panels.

STATEMENT OF PRIOR ART

Applicant is aware of the following U.S. patents the relevance of which is that they relate to hybrid-type door structures and the like. None of the patents, however, shows a closure stucture having the features of the present invention.

U.S. Pat. No. 3,318,047
U.S. Pat. No. 3,466,805
U.S. Pat. No. 3,470,653
U.S. Pat. No. 3,670,455
U.S. Pat. No. 4,007,557
U.S. Pat. No. 4,063,388
U.S. Pat. No. 4,305,227

SUMMARY OF THE INVENTION

A closure structure, i.e. a door or window structure, in accordance with the invention comprises at least one pair of panels for receipt in an opening in a building wall, a first one of the panels being adapted for hinged or pivotal type mounting in the opening for swinging open and closing movements, and the second panel being adapted for sliding movement between a fully closed position of the structure in which the panels are located substantially end-to-end, and a semi-open position of the structure in which the panels are juxtaposed face-to-face, and track means on which the second panel slides between said positions, the track means including a first pivotal section juxtaposed the first panel for swinging movements in parallel therewith, and a second section for fixing in the opening end-to-end with the first section. When the second panel is slid onto the second fixed section of the track means, it is effectively end-to-end with the first panel in the fully closed position of the structure. From the fully closed position, the second panel can be slid along the track means in the manner of a conventional sliding closure progessively increasing the extent of the opening and progressively entering the first section of the track means. When the second panel completely leaves the second section of the track means, and is within the first section, the panels are juxtaposed and the structure is in the semi-open position. Then, with the first panel swung to open position, the second panel and the first section of the track means can be swung open as a unit in order fully to open the structure and provide substantially unimpeded access across the full width of the opening. The first panel and the first section of the track means preferably are carried on seperate pivots for independent swinging movement. With this arrangement the first panel can be swung open in any position of the second panel, but the second panel can only be swung open when it is slid into the first section of the track means.

The closure structure may include a releasable stop device for preventing the second panel from being slid completely out of the fixed section of the track means, so that when partially opened, the second panel will form a bridge between the track sections precluding swinging movements of the first section of the track means. In this condition, the panels operate in the manner of a conventional sliding closure. When the swinging open facility is required, however, the stop device can be released allowing the second panel to slide fully into the first section of the track means.

Structures in accordance with the invention are simple in design and operation, may be adapted to a larger number of panels, can be adapted for commercial or domestic use, and can be operated manually.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERED EMBODIMENTS

The illustrated door structure includes a left-hand pair of door panels 10 and 12 and a similar right-hand pair of door panels 14 and 16. Panels 10 and 14 constitute first, or swinging panels of the respective pairs, and panels 12 and 16 constitute second, or sliding and swinging panels. The panels may be glazed or may be solid.

Figures 1, 3, 4:
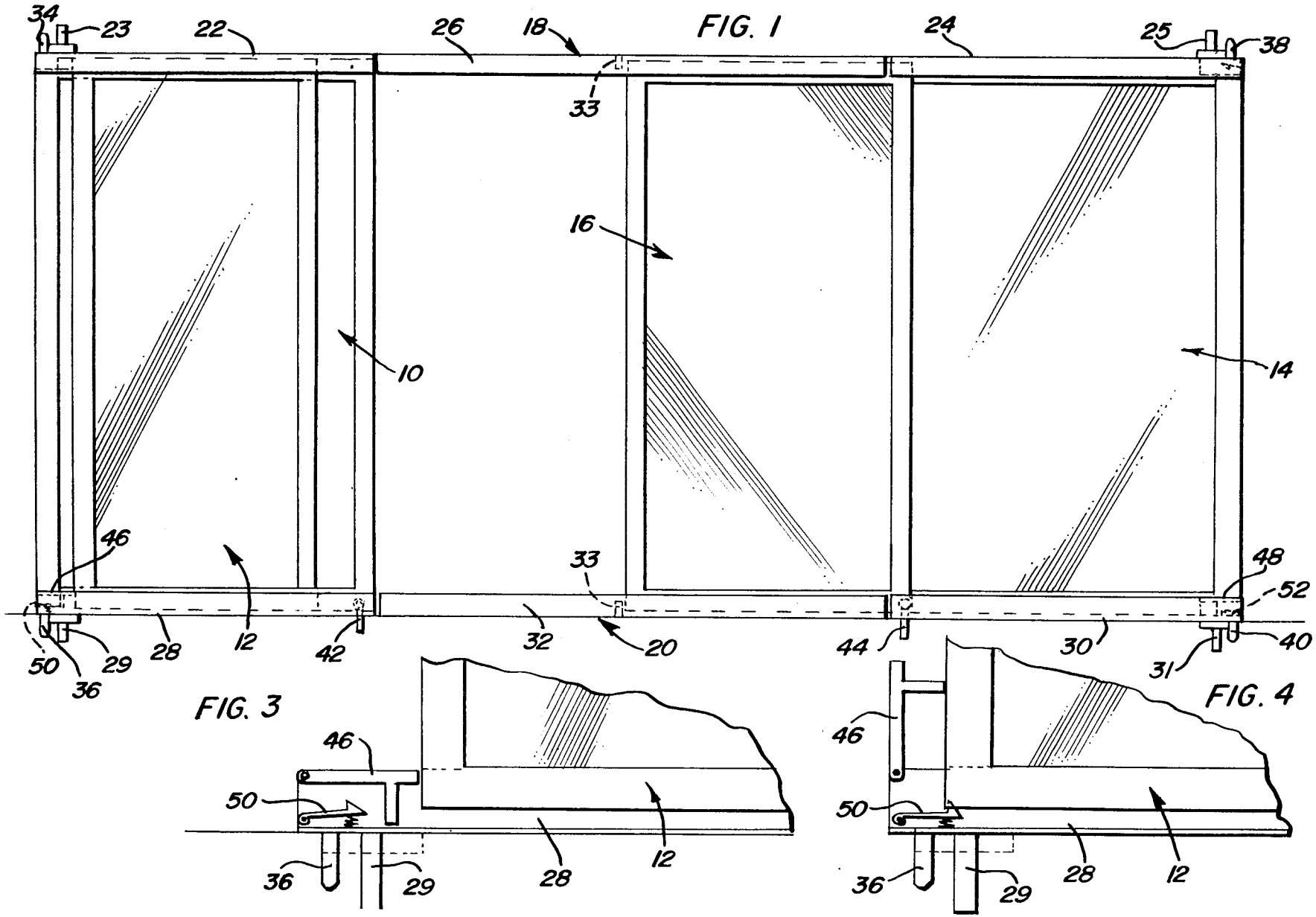
FIG. 1 is a elevational view of a four-panel door structure in accordance with the invention.
FIG. 3 is a enlarged elevational view of a corner portion of the structure showing a stop device in operative position.
FIG. 4 is a view similar to FIG. 3 showing the stop device in inoperative position.
Figure 2:
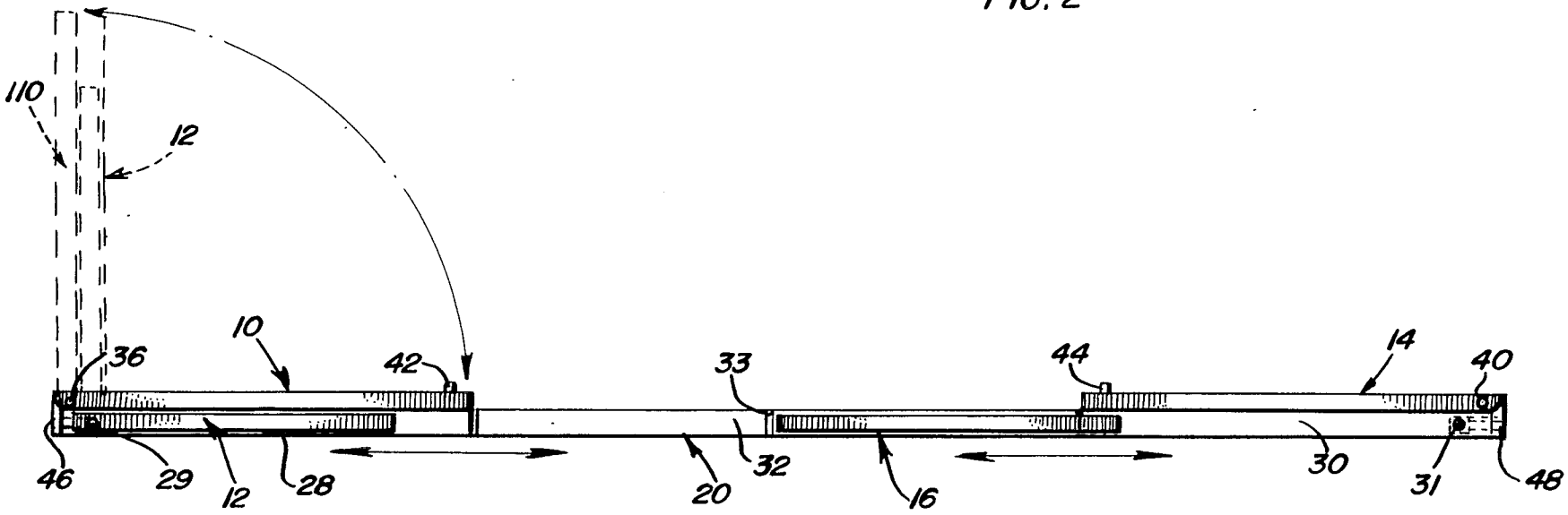
FIG. 2 is a plan view of the structure.
Figure 7:
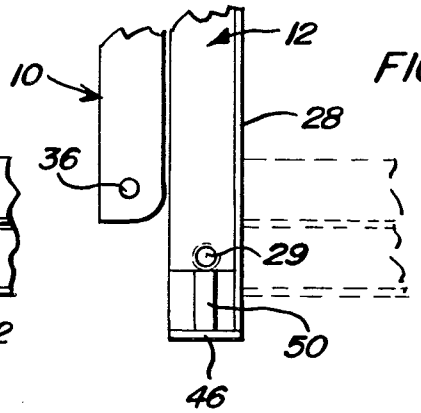
FIG. 7 is a view similar to FIG. 6 but showing a pair of door panels swung to a fully open position.
Figure 6:
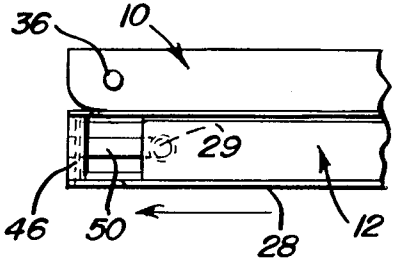
FIG. 6 is a plan view of the corner portion in the configuration shown in FIG. 4.
Figure 5:
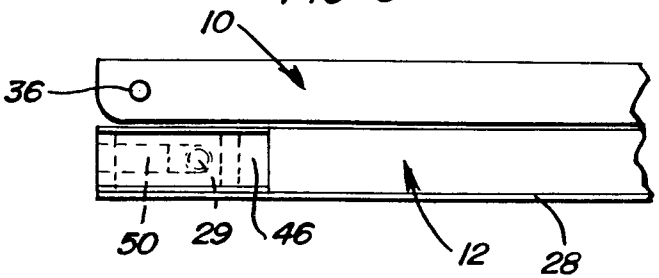
FIG. 5 is a plan view of the corner portion in the configuration shown in FIG. 3.

Sliding panels 12 and 16 are located in a plane immediately adjacent (behind) a plane containing panels 10 and 14, and can slide between a fully closed or central position wherein they are substantially end-to-end with panels 10 and 14 (panel 16 is shown in this position in FIGS. 1 and 2) to a semi-open position of the structure in which they are juxtaposed behind panels 10 and 14 (panel 12 shown in this position in FIGS. 1 and 2). Swining panels 10 and 14 can be swung open in any position of panels 12 and 16. Further, when a sliding panel is juxtaposed behind the respective swinging panel, the sliding panel can also be swung open to provide the fully open position of the panels as shown in dotted line in FIG. 2. When both pairs of panels are thusly fully opened, substantially unimpeded access is provided across the full width of the doorway opening. The means for enabling these operations to be carried out will now be described in more detail.

Panels 12 and 16 slide in upper and lower tracks indicated generally by references 18 and 20 respectively. Upper track has outer (or first) sections 22, 24 and a central (or second) section 26. Similarly, lower track 20 has outer (first) sections 28, 30 and a central (second) section 32. The outer track sections 22, 28 at the left-hand side of the door (as seen in FIGS. 1 and 2) are mounted on respective pivots 23, 29 in the door frame or the like, while the outer track sections 24, 30 are likewise mounted on respective pivots 25, 31. The central track sections 26, 32 are fixed in a door frame or the like (not shown) in which the panels are mounted.

The central track sections 26, 32 may have central stops 33 for the sliding panels, and the swinging panels 10, 14 may be carried for example on pivot pins 34, 36, 38, 40, hinges or the like received in the door frame. Bolt-type locks 42, 44 or the like may be provided for releasably retaining the swinging panels in the closed position. The sliding panels 12, 16 may have a width such that when they are fully closed against stops 33 their outer ends bridge the gap between the central fixed track sections and the outer swinging track sections thereby preventing the outer track sections from swinging open. Sliding panel 16 is illustrated in this manner in FIGS. 1 and 2. Further, when either of the sliding panels 12, 16 is in an intermediate position between the fully closed and the semi-open position, part of the panel is in the fixed central track sections 26, 32 and part of the panel is in the outer track sections of one or other of the swinging panels, so that in the intermediate positions of a sliding panel it also forms a bridge between the central track sections and the outer track sections, thereby preventing the outer track sections from being swung open.

Further, in accordance with the invention, a releasable stop assembly as will be described, is provided in conjuction with each outer track section 28, 30 to prevent the respective sliding panel from being moved fully into the respective outer track section, i.e. preventing the sliding panel from being moved beyond a bridging position between the central and outer track sections, so that when the stop device is operative the panels 10 and 16 can only be used in the sliding mode.

The stop devices comprise respective pivoted levers 46, 48 situated at the outer ends of the respective outer track sections. When the respective lever is in the down position (FIG. 3) its free end forms a stop preventing the respective sliding panel from being moved fully into the outer track section. The lever may, however, be raised manually (a finger indent may be provided in the lever) to the position shown in FIG. 4, allowing the sliding panel to move fully into the outer track section, thereby freeing the respective outer track section for swinging movement on their respective pivots 23, 29, 25, 31. Further, sprung latches 50, 52, may be provided under the respective levers for positively engaging the respective sliding panel when it is moved fully into the respective outer track section, so as to retain the sliding panel therein during swinging movement of the panel and track section.

It will be appreciated from the foregoing that the invention provides a simple yet unique form of hybrid sliding-pivoting door or window structure adaptable to diverse applications. While the illustrated embodiment shows a four-panel door structure, the number of panels can be varied.

Although, as described, it is preferred that the outer track sections be pivotally mounted in the door frame independently of swinging panels; it may in the alternative be possible for the outer track sections to be associated with the swinging panels and pivot in unison therewith.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A closure structure, namely one of a door and window structure, for receipt in an opening in a building wall and the like comprising at least one pair of cooperative panels including a first panel having means for mounting same in the opening for swinging open and closed, and a second panel for sliding relative to the first panel between a fully closed position of the structure in which the panels are located substantially end-to-end, and a semi-opened position of the structure in which the panels are juxtaposed face-to-face, the structure further including track means on which the second panel slides between said positions, the track means including a first pivoted section juxtaposed the first panel for swinging movements sustantially in parellel therewith, and a second section for fixing in the opening end-to-end with the first section whereby the second panel can be slid along the track means between the respective sections thereof and when fully received in the first section can be swung open as a unit with the first section so as to provide substantially unobstructed access across the full width of the opening.

2. The invention of claim 1 wherein the track means comprises upper and lower tracks located top and bottom of the panels respectively and each comprising respective first and second track sections.

3. The invention of claim 1 wherein the structure includes at least two first panels positioned outwardly on opposite sides of the second panel.

4. The invention of claim 1 wherein the first track section and the first panel are independently carried in a door frame or the like on separate pivot means.

5. The invention of claim 1 including stop means associated with the first track section for precluding movement of the second panel toward the semi-opened position of the structure beyond a position wherein the second panel bridges the first and second track sections thereby precluding swinging movements of the first track section.

6. The invention of claim 5 wherein the stop means comprises a pivotal lever in an outer end of the first track section for precluding movement of the second panel as aforesaid when received in the first track section and for allowing movement of the second panel to the semi-open position when swung outwardly of the first track section.

7. The invention of claim 6 including a releasable latch device in the first track section for retaining the second panel therein when the second panel is moved to the semi-open position of the structure.

8. The invention of claim 7 wherein the latch device includes a sprung latch member positioned under said pivotal lever.

9. The invention of claim 1 wherein the structure comprises two pairs of said panels, the respective first panels being located outwardly of the respective second panels.

10. The invention of claim 9 wherein the second track sections of the respective pairs of panels are incorporated into a composite central track section of the structure.

* * * * *